US009291952B2

(12) United States Patent
Hozumi et al.

(10) Patent No.: US 9,291,952 B2
(45) Date of Patent: Mar. 22, 2016

(54) BELT ASSEMBLY AND IMAGE FORMING APPARATUS INCLUDING SAME

(71) Applicants: Yoshiki Hozumi, Kanagawa (JP); Naoki Iwaya, Tokyo (JP); Yasufumi Takahashi, Kanagawa (JP); Masaharu Furuya, Kanagawa (JP); Naomi Sugimoto, Kanagawa (JP); Kazuchika Saeki, Kanagawa (JP)

(72) Inventors: Yoshiki Hozumi, Kanagawa (JP); Naoki Iwaya, Tokyo (JP); Yasufumi Takahashi, Kanagawa (JP); Masaharu Furuya, Kanagawa (JP); Naomi Sugimoto, Kanagawa (JP); Kazuchika Saeki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/605,459

(22) Filed: Jan. 26, 2015

(65) Prior Publication Data

US 2015/0227089 A1 Aug. 13, 2015

(30) Foreign Application Priority Data

Feb. 7, 2014 (JP) ..... 2014-022388

(51) Int. Cl.
*G03G 15/16* (2006.01)

(52) U.S. Cl.
CPC .... *G03G 15/1615* (2013.01); *G03G 2215/0129* (2013.01); *G03G 2215/1623* (2013.01)

(58) Field of Classification Search
CPC ..... G03G 15/1615; G03G 2215/00151; G03G 2215/00168; G03G 2215/1623
See application file for complete search history.

(56) References Cited

U.S. PATENT DOCUMENTS

2006/0119029 A1* 6/2006 Kitamura ..... 271/275
2011/0293336 A1* 12/2011 Noso et al. ..... 399/302

(Continued)

FOREIGN PATENT DOCUMENTS

JP 2006-267243 10/2006
JP 2008-026453 2/2008

(Continued)

OTHER PUBLICATIONS

U.S. Appl. No. 14/690,857, filed Apr. 20, 2015.

*Primary Examiner* — David Gray
*Assistant Examiner* — Carla Therrien
(74) *Attorney, Agent, or Firm* — Oblon, McClelland, Maier & Neustadt, L.L.P.

(57) ABSTRACT

A belt assembly includes a belt formed into an endless loop, a plurality of support rollers with a rotary shaft, a shaft-end retainer, a movable supporting member, and a drive transmission device. The plurality of support rollers includes a first support roller and a second support roller. The shaft-end retainer is disposed at each end of the rotary shaft of the plurality of support rollers. The movable supporting member supports the first support roller and is movably disposed relative to the shaft-end retainer. The drive transmission device transmits a driving force to one of the plurality of support rollers. The drive transmission device and the movable supporting member are disposed on a same side as the shaft-end retainer in an axial direction of the plurality of support rollers. The drive transmission device is disposed between the shaft-end retainer and the movable supporting member in the axial direction.

9 Claims, 8 Drawing Sheets

(56) References Cited

U.S. PATENT DOCUMENTS

| | | | | |
|---|---|---|---|---|
| 2012/0234656 | A1* | 9/2012 | Yamaoka | 198/806 |
| 2013/0192959 | A1* | 8/2013 | Kitamura | 198/806 |
| 2013/0306440 | A1 | 11/2013 | Asaoka et al. | |
| 2013/0306441 | A1 | 11/2013 | Asaoka et al. | |
| 2014/0008184 | A1 | 1/2014 | Hozumi et al. | |
| 2014/0083821 | A1 | 3/2014 | Hozumi et al. | |
| 2014/0183007 | A1 | 7/2014 | Hozumi et al. | |
| 2014/0209437 | A1 | 7/2014 | Hozumi et al. | |
| 2015/0090564 | A1* | 4/2015 | Iwaya et al. | 198/835 |
| 2015/0117914 | A1* | 4/2015 | Hozumi et al. | 399/312 |
| 2015/0125189 | A1* | 5/2015 | Hozumi et al. | 399/308 |

FOREIGN PATENT DOCUMENTS

| | | |
|---|---|---|
| JP | 2010-230958 | 10/2010 |
| JP | 2012-103286 | 5/2012 |

* cited by examiner

IMMEDIATELY AFTER ASSEMBLY

AFTER ADJUSTMENT

BELT ASSEMBLY AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2014-022388, filed on Feb. 7, 2014, in the Japan Patent Office, the entire disclosure of which is hereby incorporated by reference herein.

BACKGROUND

1. Technical Field

Exemplary aspects of the present disclosure generally relate to a belt assembly that includes a belt formed into an endless loop and entrained about a plurality of rollers and an image forming apparatus including the belt assembly, and more particularly to, an image forming apparatus, such as a copier, a facsimile machine, a printer, or a multi-functional system including a combination thereof.

2. Description of the Related Art

In known image forming apparatuses, a belt formed into an endless loop is employed for an image bearer such as a latent image bearing member and an intermediate transfer member for carrying an image on its outer circumferential surface and a conveyor system for carrying a sheet-type medium. A belt assembly equipped with such an endless looped belt includes a plurality of support rollers, and the belt is entrained about and stretched taut at a certain tension between the plurality of support rollers. The plurality of support rollers is arranged at predetermined shaft intervals. A shaft-end retainer such as a frame supports directly or indirectly both ends of the shaft of the support rollers.

Normally, one of the support rollers constitutes a drive roller to move the belt. A drive transmission device such as a gear train including an idler gear and a drive gear is disposed at the end of the shaft of the drive roller. Driving power is transmitted from a drive source to the drive roller via the drive transmission device. Rotation of the drive roller causes the belt to travel. Generally, one of the support rollers constitutes a tension roller biased against the belt by a biasing device, thereby applying a desired tension to the belt.

SUMMARY

In view of the foregoing, in an aspect of this disclosure, there is provided an improved belt assembly including a belt, a plurality of support rollers with a rotary shaft, a shaft-end retainer, a movable supporting member, and a drive transmission device. The belt is formed into an endless loop and is entrained about the plurality of support rollers that keeps the belt taut. The plurality of support rollers includes a first support roller and a second support roller. The shaft-end retainer is disposed at each end of the rotary shaft of the plurality of support rollers. The movable supporting member supports the first support roller and is movably disposed relative to the shaft-end retainer. The drive transmission device transmits a driving force to one of the plurality of support rollers. The drive transmission device and the movable supporting member are disposed on a same side as the shaft-end retainer in an axial direction of the plurality of support rollers. The drive transmission device is disposed between the shaft-end retainer and the movable supporting member in the axial direction.

According to another aspect, an image forming apparatus includes a belt assembly. The belt assembly includes a belt, a plurality of support rollers with a rotary shaft, a shaft-end retainer, a movable supporting member, and a drive transmission device. The belt is formed into an endless loop and is entrained about the plurality of support rollers that keeps the belt taut. The plurality of support rollers includes a first support roller and a second support roller. The shaft-end retainer is disposed at each end of the rotary shaft of the plurality of support rollers. The movable supporting member supports the first support roller and is movably disposed relative to the shaft-end retainer. The drive transmission device transmits a driving force to one of the plurality of support rollers. The drive transmission device and the movable supporting member are disposed on a same side as the shaft-end retainer in an axial direction of the plurality of support rollers. The drive transmission device is disposed between the shaft-end retainer and the movable supporting member in the axial direction.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
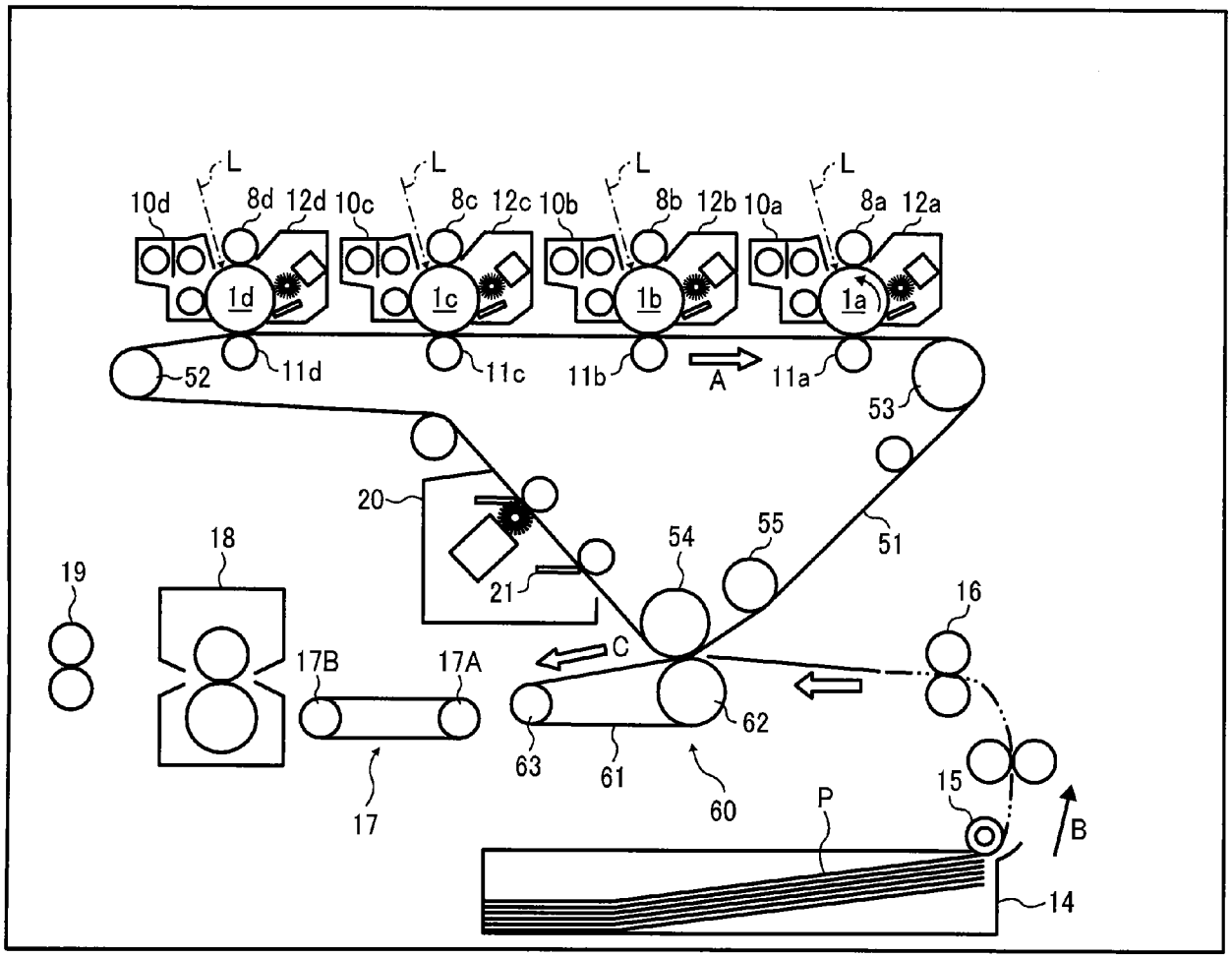
FIG. 1 is a schematic diagram illustrating a printer as an example of an image forming apparatus.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

Referring now to FIG. 1, there is provided a schematic diagram illustrating a printer as an example of an image forming apparatus according to illustrative embodiments of the present disclosure.

The image forming apparatus includes four photoconductors 1*a*, 1*b*, 1*c*, and 1*d* disposed inside a main body housing of the image forming apparatus. Toner images of different colors are formed on the respective photoconductors 1*a*, 1*b*, 1*c*, and 1*d*. More specifically, a black toner image, a magenta toner image, a cyan toner image, and a yellow toner image are formed on the photoconductors 1*a*, 1*b*, 1*c*, and 1*d*, respectively. According to the present illustrative embodiment, the photoconductors 1*a*, 1*b*, 1*c*, and 1*d* have a drum shape. Alternatively, the photoconductors 1*a*, 1*b*, 1*c*, and 1*d* may employ an endless looped belt entrained about a plurality of rollers and driven to rotate.

The image forming apparatus includes an intermediate transfer belt 51 formed into an endless loop as an intermediate transfer member which serves as an image bearing member. The intermediate transfer belt 51 faces the four photoconductors 1*a*, 1*b*, 1*c*, and 1*d*. The outer circumferential surface of each of the photoconductors 1*a*, 1*b*, 1*c*, and 1*d* contacts the outer circumferential surface of the intermediate transfer belt 51. The intermediate transfer belt 51 is entrained about and stretched taut between a plurality of support rollers: a tension roller 52, a drive roller 53, a repulsive roller 54, an entry roller 55, and so forth. The drive roller 53, which is one of support rollers, is driven to rotate by a drive source, and rotation of the drive roller 53 enables the intermediate transfer belt 51 to travel in a direction of hollow arrow A in FIG. 1.

The intermediate transfer belt 51 may be a single-layer belt or a multi-layer belt. In the case of the multi-layer belt, a base layer of the belt may be formed of a relatively inelastic fluorine resin such as a polyvinylidene fluoride (PVDF) sheet and polyimide resin, with a smooth coating layer of fluorine resin deposited on the outer surface of the belt. In the case of a single-layer belt, the belt material may be selected from, for example, polyvinylidene difluoride (PVDF), polycarbonate (PC), and polyimide (PI).

The configuration and operation for forming toner images on each of the photoconductors 1*a*, 1*b*, 1*c*, and 1*d*, all have a similar or the same configuration as all the others, differing only in the color of toner employed. Similarly, the configuration and operation for transferring primarily the toner images onto the intermediate transfer belt 51 have a similar or the same configuration as all the others, differing only the color of toner employed. Thus, a description is provided only of the photoconductor 1*a* for forming a black toner image and its associated imaging equipment as an example of the photoconductors and associated imaging equipment. The description of the photoconductors 1*b*, 1*c*, and 1*d*, and associated imaging equipment are omitted herein, unless otherwise indicated.

The photoconductor 1*a* rotates in the counterclockwise direction indicated by arrow in FIG. 1. The outer circumferential surface of the photoconductor 1*a* is irradiated with light from a static eliminating device, thereby initializing the surface potential of the photoconductor 1*a*. The initialized surface of the photoconductor 1*a* is charged uniformly by a charging device 8*a* to a predetermined polarity (in the present illustrative embodiment, a negative polarity). Similarly, the initialized photoconductors 1*b*, 1*c*, and 1*d* are charged uniformly by charging devices 8*b*, 8*c*, and 8*d*. Subsequently, an exposure device irradiates the charged surface of the photoconductor 1*a* with a modulated laser beam L, thereby forming an electrostatic latent image on the surface of the photoconductor 1*a*. According to the present illustrative embodiment, the exposure device that projects the laser beam L includes a laser writing device. Alternatively, the exposure device may include an LED array and an imaging device.

The electrostatic latent image formed on the photoconductor 1*a* is developed with a respective color of toner, i.e., black, by a development device 10*a* into a visible image, known as a black toner image. Reference numerals 10*b*, 10*c*, and 10*d* also refer to development devices.

Primary transfer rollers 11*a*, 11*b*, 11*c*, and 11*d* serving as primary transfer devices are disposed inside the looped intermediate transfer belt 51, facing the photoconductors 1*a*, 1*b*, 1*c*, and 1*d*, respectively. The primary transfer roller 11*a*, hereinafter described as a representative example of the primary transfer rollers, contacts the inner circumferential surface of the intermediate transfer belt 51 to form a primary transfer nip between the photoconductor 1*a* and the intermediate transfer belt 51. The primary transfer roller 11*a* is supplied with a primary transfer voltage having a polarity (in the present illustrative embodiment, a positive polarity) opposite a charge polarity of the toner image formed on the photoconductor 1*a*, thereby forming a primary transfer electric field between the photoconductor 1*a* and the intermediate transfer belt 51 and transferring electrostatically the toner image onto the intermediate transfer belt 51. After the toner image is primarily transferred onto the intermediate transfer belt 51, residual toner remaining on surface of the photoconductor 1*a* is removed by a cleaning device 12*a*. Similarly, the photoconductors 1*b*, 1*c*, and 1*d* are cleaned by cleaning devices 12*b*, 12*c*, and 12*d*, respectively.

In a full-color mode in which toner images of four different colors are formed, similar to the black toner image, a magenta toner image, a cyan toner image, and an yellow toner image are formed on the photoconductors 1*b*, 1*c*, and 1*d*, respectively. As described above, the toner images in the colors magenta, cyan, and yellow are transferred onto the intermediate transfer belt 51, such that they are superimposed one atop the other on the black toner image which has been primarily transferred onto the intermediate transfer belt 51.

When forming a single color image of black color, such as in a monochrome mode, the primary transfer rollers 11*b*, 11*c*, and 11*d*, other than the primary transfer roller 11*a* for black, are separated from the photoconductors 1*b*, 1*c*, and 1*d* for the colors magenta, cyan, and yellow by a moving device. In a state in which only the photoconductor 1*a* is in contact with the intermediate transfer belt 51, only the black toner image is transferred primarily onto the intermediate transfer belt 51.

As illustrated in FIG. 1, a paper feed device 14 is disposed substantially at the bottom of the main body of the image forming apparatus. The paper feed device 14 includes a feed roller 15 to pick up and send a recording medium P as a sheet-type medium in a direction indicated by an arrow B in FIG. 1. The recording medium P fed by the feed roller 15 is delivered in a predetermined timing to a secondary transfer nip at which the intermediate transfer belt 51 entrained about the repulsive roller 54 contacts a secondary transfer belt 61 of a secondary transfer device 60. The recording medium P is sent to the secondary transfer nip in appropriate timing by a pair of registration rollers 16. At this time, the repulsive roller 54 is supplied with a predetermined secondary transfer voltage to transfer secondarily the toner image from the intermediate transfer belt 51 onto the recording medium P.

The secondary transfer belt 61 formed into an endless loop is entrained about and stretched taut between a separation roller 63 and a secondary transfer roller 62. The separation roller 63 serves as a first support roller and also as a tiltable rotary member. The secondary transfer roller 62 serves as a second support roller.

According to the present illustrative embodiment, the secondary transfer roller 62 serves as a drive roller that is rotated by a drive source via a drive transmission device 80, thereby rotating the secondary transfer belt 61 in a direction indicated by a hollow arrow C in FIG. 1.

The recording medium P, onto which the toner image is secondarily transferred, is carried on the outer circumferential surface of the secondary transfer belt 61 and transported while the recording medium P is absorbed electrostatically to the outer circumferential surface of the secondary transfer belt 61. Subsequently, the recording medium P separates from the surface of the secondary transfer belt 61 at the curved portion of the secondary transfer belt 61 entrained about the separation roller 63, and is transported further downstream from the secondary transfer belt 61 in a transport direction of the recording medium P by a conveyor belt 17 disposed downstream from the secondary transfer belt 61. The conveyor belt 17 is entrained about and stretched taut between a first roller 17A and a second roller 17B. The first roller 17A serves as a drive roller and as an entry roller. The second roller 17B serves as a driven roller. When the recording medium P passes through a fixing device 18 which applies heat and pressure to the toner image on the recording medium P, the toner image is fixed to the recording medium P. After the recording medium P passes through the fixing device 18, the recording medium P is discharged outside the main body through a pair of output rollers 19 of a discharge unit.

Residual toner remaining on the intermediate transfer belt 51 after the toner image is secondarily transferred therefrom is removed by a belt cleaning device 20. In the present illustrative embodiment, the belt cleaning device 20 includes a cleaning blade 21 made of suitable material, such as urethane, held against the intermediate transfer belt 51 to mechanically remove or scrape toner residues from the belt surface. Alternatively, instead of or in combination with a cleaning blade, any suitable cleaning device may be used to clean the intermediate transfer belt 51, including, for example, an electrostatic cleaning device for electrostatically removing toner residues from the belt surface.

In order to facilitate an understanding of the novel features of the present disclosure, as a comparison a description is provided of a comparative example of a belt assembly. In one example of the belt assembly in which one end of the rotary shaft of one of the support rollers around which a conveyor belt is entrained is movably held by a movable support member, thereby enabling the support roller to swingably move. The belt assembly employs the movable support member to correct alignment of the belt which repeatedly wanders to one side in the width direction of the belt.

The plurality of support rollers of this type of the belt assembly consists of a drive roller, a driven roller, and an inclination roller. The ends of the shafts of the drive roller and the driven roller are supported by a main body (i.e., a shaft-end retainer) of the belt assembly, and the inclination roller is supported by the main body via an interlocking member (i.e., the movable support member).

The interlocking member includes a pair of link members swingably connected to each other via a connecting pin. One of the link members is swingably held by the main body, and the other link member rotatably supports the end of the shaft of the inclination roller. A tension spring is attached to the end of the interlocking member and applies always a returning force to the inclination roller via the interlocking member.

The belt alignment device is attached to each end of the rotary shaft of the inclination roller. The belt alignment device contacts the edge of the belt, thereby being pushed by the belt raveling off center in the width direction. Accordingly, the belt alignment device moves in a direction in which the belt alignment device separates from the belt on the axial line of the inclination roller. The belt alignment device includes a slanted surface which inclines outside the axial line towards the lower side.

A force conversion device fixed to the main body contacts the slanted surface of the belt alignment device. As the belt alignment device is pushed by the belt and moves in the axial direction of the belt, the contact position of the belt alignment device in contact with the force conversion device shifts upward along the slanted surface of the belt alignment device.

As the contact position of the belt alignment device and the force conversion device shifts upward, the belt alignment device pushes down the rotary shaft of the inclination roller and tilts the inclination roller against the tension of the tension spring via the interlocking member. As a result, the belt moves in the opposite direction in the belt width direction. With reduced pressure of the belt against the belt alignment device, the returning force of the tension spring pushes up the rotary shaft of the inclination roller via the interlocking member. As the rotary shaft of the inclination roller is pushed up, the contact position of the belt alignment device and the force conversion device shifts downward along the slanted surface of the belt alignment device. Then, the belt alignment device moves on the axial line of the inclination roller towards the belt. Accordingly, belt misalignment is corrected repeatedly.

Another example of the belt assembly equipped with the movable support member, other than the belt alignment device, includes a feeding device that feeds an object such as a sheet of recording medium from a stack of recording media using electrostatic absorption force.

In order to satisfy recent demand for downsizing of an image forming apparatus, it is necessary to reduce the space between each of the shafts of the support rollers around which the belt is entrained.

However, in this type of the belt assembly using the movable support member in which the drive transmission device and the movable support member are arranged at the same side as the shaft-end retainer in the axial direction of the support rollers, if the space between the shafts of the support rollers is small, the drive transmission device disposed at the shaft end of the support rollers and the movable support member interfere with each other. In order to prevent the interference, a relief hole for the rotary shaft of the drive transmission device such as the drive gear and the idler gear is formed in the movable support member, or the rotary shaft of the drive gear and the idler gear disposed on the shaft-end retainer is situated such that the rotary shaft does not overlap with the projection area of the movable support member when the shaft-end retainer is illuminated with normal light.

In order to make up for the reduced strength of parts due to the relief hole, the size of the movable support member is increased and/or the distance between the drive transmission device and the movable support member is increased, hence increasing the size of the shaft-end retainer. As a result, the size of the belt assembly as a whole increases.

The increase in the size of the belt assembly is caused not only when disposing the movable support member and the drive transmission device outside the shaft-end retainer, but also when disposing the movable support member and the drive transmission device inside the shaft-end retainer and also when using the movable support member for a purpose other than belt alignment.

In view of the above, there is demand for a compact belt assembly even when the belt assembly includes the movable support member, and the drive transmission device and the movable support member are at the same side as the shaft-end retainer in the axial direction of the support rollers.

Next, a description is provided of a belt alignment device employed in the secondary transfer device 60 equipped with the secondary transfer belt 61 according to the illustrative embodiments of the present disclosure.

According to the present illustrative embodiment, the belt alignment device employed in the secondary transfer device 60 is of a shaft-inclining type, and a shaft moving device 70 serves as the belt alignment device of the secondary transfer device 60 to tilt a rotary shaft 63*a* of the separation roller 63 about which the secondary transfer belt 61 is entrained so as to regulate the range of misalignment of the secondary transfer belt 61 within a predetermined permissible range. The separation roller 63 is one of support rollers about which the secondary transfer belt 61 is entrained.

Figure 2:
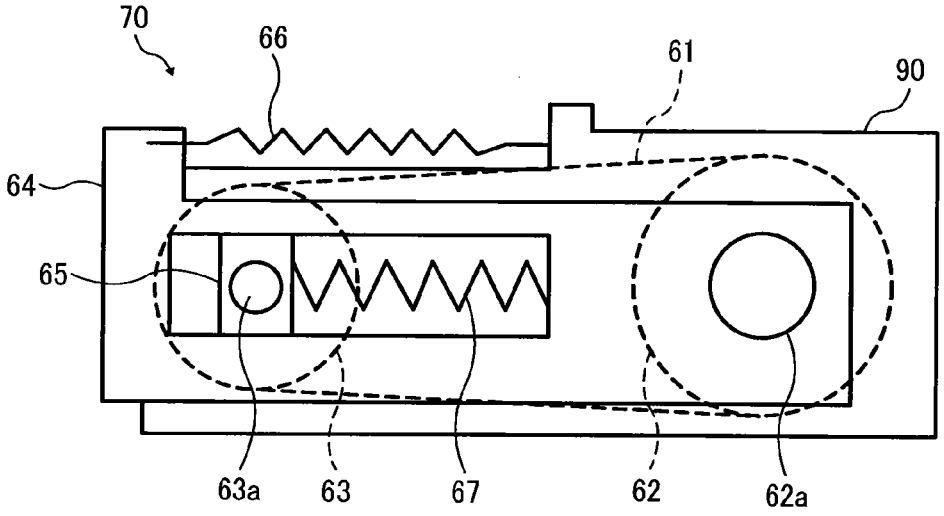
FIG. 2 is a schematic diagram illustrating a shaft moving device of a secondary transfer device employed in the image forming apparatus of FIG. 1, immediately after assembly as viewed from a proximal side in an axial direction of a separation roller.

FIG. 2 is a schematic diagram illustrating the shaft moving device 70 of the secondary transfer device 60 employed in the image forming apparatus of FIG. 1, immediately after assembly as viewed from a proximal side in an axial direction of the separation roller 63.

Figure 3:
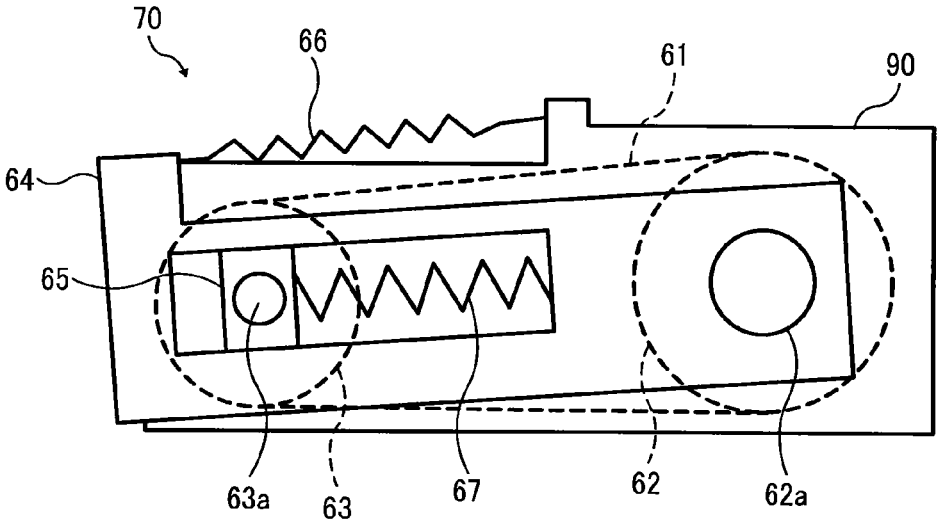
FIG. 3 is a schematic diagram illustrating the shaft moving device after adjustment of misalignment of a secondary transfer belt as viewed in the axial direction of the separation roller.

FIG. 3 is a schematic diagram illustrating the shaft moving device 70 after adjustment of misalignment of the secondary transfer belt 61 as viewed in the axial direction of the separation roller 63.

According to the present illustrative embodiment, a shaft bearing is attached to each end of the rotary shaft of the secondary transfer roller 62. The secondary transfer device 60 includes two lateral plates (also referred to as a shaft-end retainer) 90 disposed at both ends of the secondary transfer roller 62 in the axial direction thereof. Each shaft bearing of the secondary transfer roller 62 is held by each lateral plate 90. Accordingly, the secondary transfer roller 62 is rotatably supported by the lateral plates 90.

The two lateral plates 90 are attached to an exterior of a main-body frame 100 (shown in FIG. 9) of the secondary transfer device 60 in the axial direction of the support roller.

Each of two shaft support arms (movable supporting members) 64 is disposed outside each of the lateral plates 90 in the axial direction. Each end of the rotary shaft 63*a* of the separation roller 63 is attached to a slidable shaft bearing 65 held by each shaft support arm 64. Accordingly, the separation roller 63 is rotatably supported by the shaft support arm 64.

Each of the shaft support arms 64 is rotatably attached to each end of a rotary shaft 62*a* of the secondary transfer roller 62 and biased in a clockwise direction in FIG. 3 by an arm spring 66 with one end thereof fixed to the lateral plate 90. In a state in which the secondary transfer belt 61 is properly aligned immediately after assembly, a rotation position of the shaft support arms 64 is maintained at a position at which the shaft support arms 64 contact the lateral plates 90 due to a bias force of the arm spring 66.

As illustrated in FIGS. 2 and 3, each shaft support arm 64 slidably supports the slidable shaft bearing 65 that bears the rotary shaft 63*a* of the separation roller 63 such that the slidable shaft bearing 65 can slide in a radial direction from the center of rotation of the shaft support arm 64. The slidable shaft bearing 65 is biased against the shaft support arm 64 by a tension spring 67 in the radial direction from the center of rotation of the shaft support arms 64 towards outside. With this configuration, the separation roller 63 is always biased in such a direction that the separation roller 63 separates from the secondary transfer roller 62. Accordingly, a certain tension is applied to the secondary transfer belt 61 entrained around the separation roller 63 and the secondary transfer roller 62.

Figure 4:
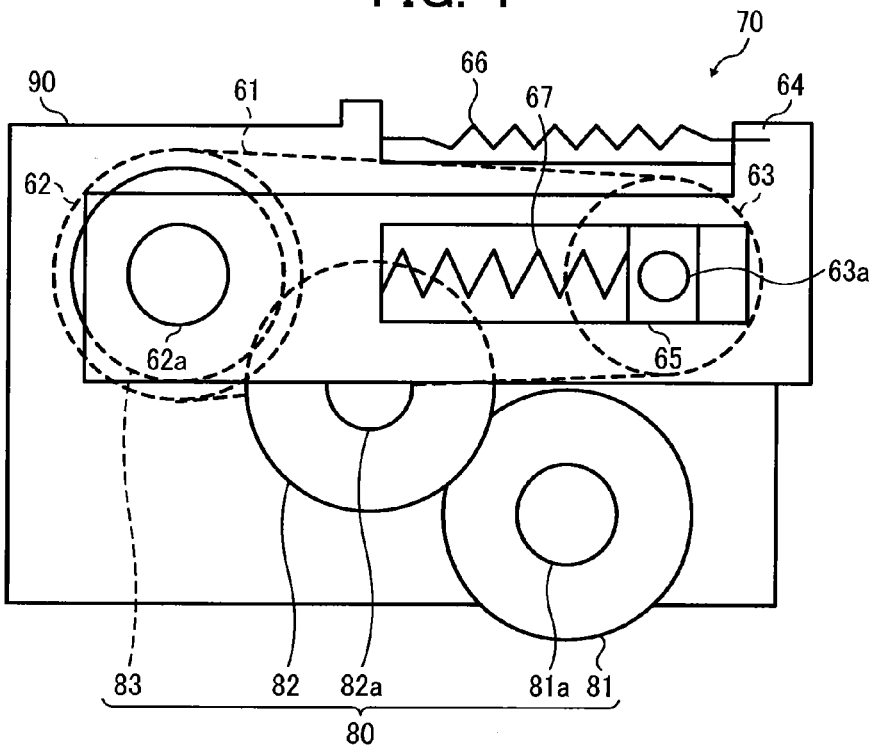
FIG. 4 is a schematic diagram illustrating the shaft moving device disposed at an opposite end of the separation roller in the axial direction of the separation roller shown in FIG. 2 as viewed from a distal side in the axial direction of the separation roller shown in FIG. 1.

FIG. 4 is a schematic diagram illustrating the shaft moving device 70 of the secondary transfer device 60 immediately after assembly, as viewed from a distal side in the axial direction of the separation roller 63.

As illustrated in FIG. 4, the drive transmission device 80 and the shaft moving device 70 are disposed at the opposite end of the shaft of the separation roller 63 shown in FIG. 3.

The drive transmission device 80 includes a drive gear 81, an idler gear 82, a secondary-transfer roller gear 83.

The drive gear 81 is supported by a drive gear shaft 81*a*. The drive gear shaft 81*a* is rotatably disposed on the main body frame 100 of the secondary transfer device 60. A rotary driving force is supplied directly to the drive gear shaft 81*a* from a drive motor or indirectly via a transmission device such as a timing belt. When the drive gear shaft 81*a* receives the driving force, the drive gear 81 rotates.

The idler gear 82 is rotatably supported on an idler shaft 82*a* disposed on the lateral plate 90. The idler shaft 82*a* is disposed at a position that allows the idler gear 82 to mesh with the drive gear 81 and the secondary-transfer roller gear 83.

The secondary-transfer roller gear 83 is supported by the rotary shaft 62*a* of the transfer roller 62. When power is supplied to the drive motor, the transfer roller 62 is rotated via the drive gear 81 and the idler gear 82, thereby rotating the secondary transfer belt 61.

The configuration of the shaft moving device 70 shown in FIG. 4 is similar to or the same as that shown in FIGS. 2 and 3.

Figure 5:
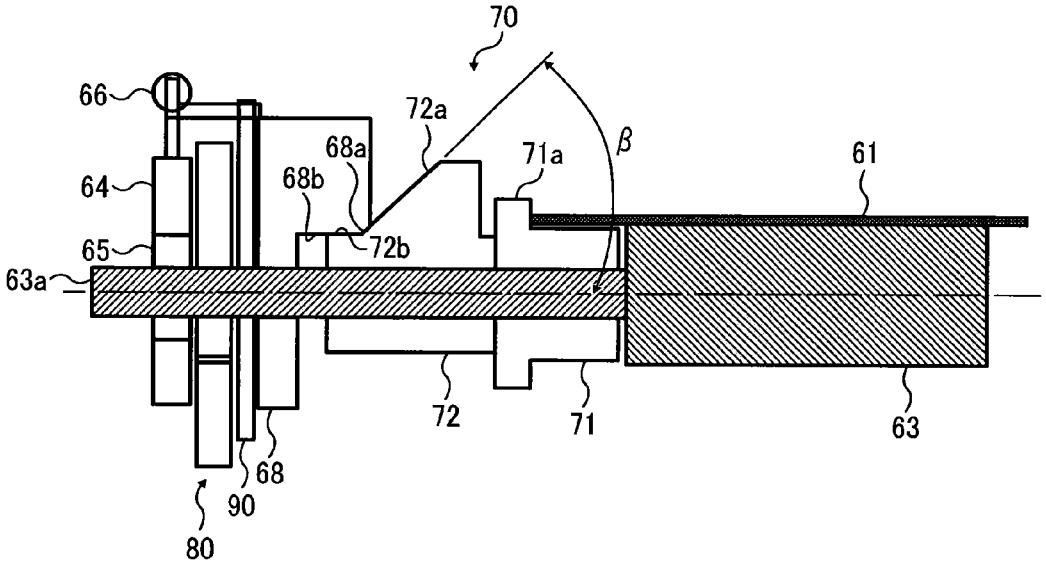
FIG. 5 is a cross-sectional diagram schematically illustrating the shaft moving device immediately after assembly, taken along a rotary shaft of the separation roller.

FIG. 5 is a cross-sectional diagram schematically illustrating the shaft moving device 70 of the secondary transfer device 60, cut along the rotary shaft 63*a* of the separation roller 63.

A belt deviation detector 71 and a shaft inclining member 72 are disposed on the rotary shaft 63*a* between the separation roller 63 and the slidable shaft bearing 65. The belt deviation detector 71 and the shaft inclining member 72 constitute an axial displacement device. The belt deviation detector 71 includes a flange 71*a* that contacts an end portion of the secondary transfer belt 61. As the secondary transfer belt 61 moves in the direction of the belt width and the end portion of the secondary transfer belt 61 contacts the flange 71*a*, exerting a force on the belt deviation detector 71, the belt deviation detector 71 moves outward in the axial direction along the rotary shaft 63*a* of the separation roller 63. As the belt deviation detector 71 moves outward in the axial direction along the rotary shaft 63*a*, the shaft inclining member 72 which is disposed beyond the belt deviation detector 71 on the rotary shaft 63*a* moves outward in the axial direction along the rotary shaft 63*a*.

A contact portion 68*a* of a shaft guide 68 serving as a power conversion member contacts a slanted surface 72*a* of the shaft inclining member 72 from outside the rotary shaft 63*a* in the axial direction. The shaft guide 68 is fixed to the main body frame 100 of the secondary transfer device 60. The end portion of the rotary shaft 63*a* of the separation roller 63 on which the shaft inclining member 72 is disposed is supported, via the shaft bearing 65, by the shaft support arm 64 which is biased by the arm spring 66. Accordingly, the end portion of the rotary shaft 63*a* is biased upward in FIG. 5. Therefore, in a state in which the end portion of the secondary transfer belt 61 is not in contact with the flange 71*a* of the belt deviation detector 71, the contact position at which the contact portion 68*a* of the shaft guide 68 and the slanted surface 72*a* of the shaft inclining member 72 contact is regulated at a position at which a first stopper surface 68*b* of the shaft guide 68 contacts a contact surface 72*b* of the shaft inclining member 72 due to the spring force of the arm spring 66.

The contact surface 72*b* of the shaft inclining member 72 is continuously formed at the lower end of the slanted surface 72*a*. That is, the contact portion 68*a* of the shaft guide 68 is held in a state in which the contact portion 68*a* contacts the lower end portion of the slanted surface 72*a* of the shaft inclining member 72.

Figure 6:
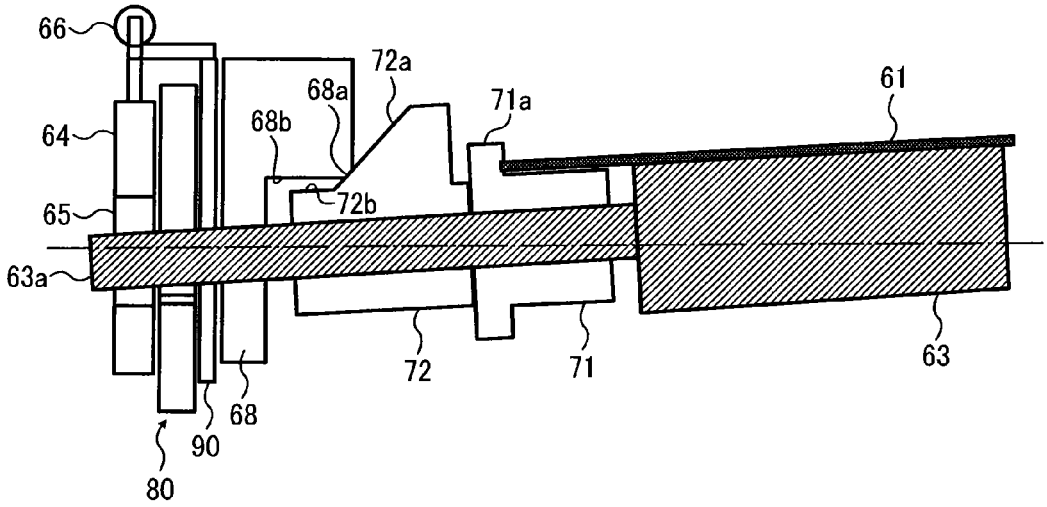
FIG. 6 is a cross-sectional diagram schematically illustrating the shaft moving device after adjustment of the misalignment of the belt, taken along the rotary shaft of the separation roller.

In this state, the secondary transfer belt 61 receives a force causing the secondary transfer belt 61 to move in the direction of the belt width, thereby moving the belt deviation detector 71 and the shaft inclining member 72 outward in the axial direction along the rotary shaft 63*a*. As a result, the contact portion 68*a* relatively moves along the slanted surface 72*a* of the shaft inclining member 72. The contact position at which the slanted surface 72*a* of the shaft inclining member 72 contacts the contact portion 68*a* of the shaft guide 68 moves up towards the upper portion of the slanted surface 72*a*. As a result, the axial end portion of the rotary shaft 63*a* of the separation roller 63 in the traveling direction of the secondary transfer belt 61 is pressed down against the biasing force of the arm spring 66 as illustrated in FIG. 6. At this time, the end portion of the secondary transfer belt 61 is not in contact with the flange 71*a* of the belt deviation detector 71. Thus, as illustrated in FIG. 5, the contact portion 68*a* of the shaft guide 68 is held in a state in which the contact portion 68*a* of the shaft guide 68 contacts the lower end portion of the slanted surface 72*a* of the shaft inclining member 72. The opposite end of the rotary shaft 63*a* of the separation roller 63, which is the opposite end in the moving direction of the secondary transfer belt 61, is pressed down relative to the other end, causing the rotary shaft 63*a* to tilt.

As the rotary shaft 63*a* of the separation roller 63 tilts further, the moving speed of the secondary transfer belt 61 in the direction of the belt width slows down gradually, and ultimately the secondary transfer belt 61 moves in the direction opposite to the direction of the belt width. As a result, the position of the secondary transfer belt 61 in the width direction returns gradually, thereby tracking the secondary transfer belt 61 correctly and enabling the secondary transfer belt 61 to travel reliably. The same is true for the case in which the direction of shift of the secondary transfer belt 61 is in the direction opposite to the direction described above.

Figure 7:
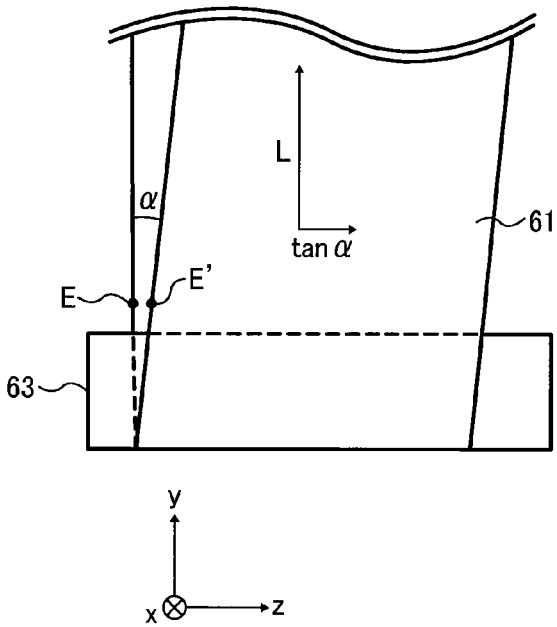
FIG. 7 is a conceptual diagram illustrating a belt skew of a secondary transfer belt.

With reference to FIG. 7, a description is provided of a principle of correction of belt misalignment by tilting the rotary shaft 63*a* of the separation roller 63.

FIG. 7 is a conceptual diagram illustrating misalignment of the secondary transfer belt 61.

Here, it is assumed that the secondary transfer belt 61 has a rigid body, and an arbitrary point (i.e., a point E on the belt end portion) on the secondary transfer belt 61 before advancing to the separation roller 63 is observed. As long as the secondary transfer belt 61 entrained about and stretched taut between two rollers, i.e., the secondary transfer roller 62 and the separation roller 63, is completely horizontal or parallel, the position of the secondary transfer belt 61 in the axial direction of the separation roller 63 does not change between the point E on the secondary transfer belt 61 immediately before advancing to the separation roller 63 and a point E' corresponding to the point E immediately after exiting the separation roller 63. In this case, the secondary transfer belt 61 does not travel out of alignment.

By contrast, in a case in which the rotary shaft 63*a* of the separation roller 63 is inclined at an inclination angle $\alpha$ relative to the rotary shaft 62*a* of the secondary transfer roller 62, the point E on the secondary transfer belt 61 shifts by an amount of tan a in the axial direction of the separation roller 63 while moving along the peripheral surface of the separation roller 63 as illustrated in FIG. 7. Therefore, by tilting the rotary shaft 63*a* of the separation roller 63 at the inclination angle α relative to the rotary shaft 62*a* of the secondary transfer roller 62, the position of the secondary transfer belt 61 in the width direction of the belt can be moved approximately by the amount of tan a in accordance with the rotation of the separation roller 63.

The amount of belt misalignment (moving speed in the width direction of the belt) of the secondary transfer belt 61 is proportional to the inclination angle α. That is, the greater is the inclination angle α, the greater is the amount of displacement of the secondary transfer belt 61. The smaller is the inclination angle α, the smaller is the amount of displacement of the secondary transfer belt 61. For example, in a case in which the secondary transfer belt 61 wanders to the left side as illustrated in FIG. 6, this belt misalignment causes the shaft inclining member 72 to move in the axial direction of the separation roller 63, thereby moving the rotary shaft 63*a* of the separation roller 63 down in FIG. 6 and thus returning the secondary transfer belt 61 to the right in FIG. 6. With this configuration, the rotary shaft 63*a* of the separation roller 63 is inclined, hence moving the secondary transfer belt 61 in the opposite direction to the direction of the initial belt misalignment and thus compensating the initial belt misalignment of the secondary transfer belt 61. In other words, the secondary transfer belt 61 is moved to a place at which the initial belt misalignment and the displacement of the secondary transfer belt 61 caused by the inclination of the rotary shaft 63*a* are balanced, thereby correcting the misalignment of the secondary transfer belt 61.

In the event in which the secondary transfer belt 61 traveling at the balanced position starts to wander towards either side, the inclination of the rotary shaft 63*a* of the separation roller 63 in accordance with the displacement of the secondary transfer belt 61 brings the secondary transfer belt 61 to the balanced position again.

According to the present illustrative embodiment, the shaft moving device 70 of the secondary transfer device 60 tilts the rotary shaft 63*a* of the separation roller 63 at an inclination angle corresponding to the amount of displacement of the secondary transfer belt 61 in the direction of the belt width. Accordingly, misalignment of the secondary transfer belt 61 is corrected fast. Furthermore, in order to tilt the rotary shaft 63*a* of the separation roller 63, the moving force of the secondary transfer belt 61 moving in the direction of the belt width is used so that an additional drive source such as a motor is not necessary and hence no extra space is needed to accommodate the drive source. The rotary shaft 63*a* of the separation roller 63 can be tilted with a simple configuration without a dedicated drive source.

Figure 8:
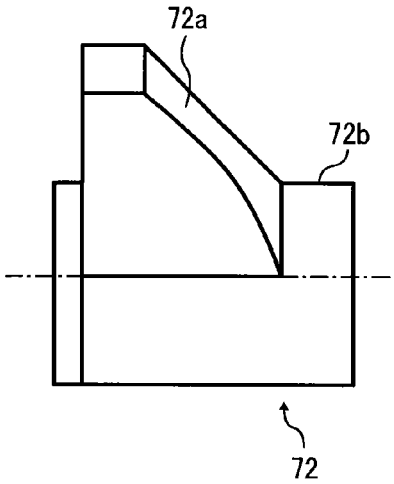
FIG. 8 is a perspective view schematically illustrating a shaft inclining member of the shaft moving device.

Next, with reference to FIG. 8, a description is provided of the shaft inclining member 72.

FIG. 8 is a perspective view schematically illustrating the shaft inclining member 72 according to an illustrative embodiment of the present disclosure.

According to the present illustrative embodiment, the shaft inclining member 72 includes a cylindrical main body, and the outer circumferential surface of the cylindrical main body includes the slanted surface 72*a*. The slanted surface 72*a* is formed of a curved surface that constitutes a part of the circumference of a conical shape, the center of which coincides with the center axis of the cylindrical main body.

There are two reasons for forming the slanted surface 72*a* with a curved surface. The first reason is that even when the shaft inclining member 72 rotates slightly around the rotary shaft 63*a* of the separation roller 63, the angle of inclination of the separation roller 63 does not change. The second reason is that the curved surface of the slanted surface 72*a* allows the slanted surface 72*a* and the contact portion 68*a* of the shaft guide 68 to make a point contact, thereby reducing friction at the contact place. With this configuration, the contact pressure at the end portion of the secondary transfer belt 61 contacting the belt deviation detector 71 is reduced, thereby reducing damage to the end portion of the secondary transfer belt 61 and hence achieving extended belt life expectancy. According to the present illustrative embodiment, the slanted surface 72*a* is tilted at an inclination angle 13 of approximately 30° relative to the rotary shaft 63*a*. Preferred material of the shaft inclining member 72 includes, but is not limited to, polyacetal (POM).

A bending stress acts repeatedly on the end portion of the secondary transfer belt 61 due to contact with the belt deviation detector 71, thus resulting in damage or breakage of the secondary transfer belt 61. For this reason, in some embodiments, a reinforcing tape is adhered around the inner and outer circumferential surfaces at the end of the secondary transfer belt 61.

Next, a description is provided of an example of the separation roller 63 and the secondary transfer belt 61.

The outer diameter of the separation roller 63 is ϕ15. Material for the separation roller 63 is aluminum. Material for the secondary transfer belt 61 is polyimide. Young's modulus of the secondary transfer belt 61 is 3000 Mpa. Folding endurance of the secondary transfer belt 61 using MIT-type folding endurance tester is 6000 times. The thickness of the secondary transfer belt 61 is 80 μm. The linear velocity of the secondary transfer belt 61 is 352 mm/s. The belt tension is 0.9 N/cm. The measuring method of the MIT-type folding endurance test conforms to Japanese Industrial Standard (JIS)-P8115. More specifically, the measuring conditions of the folding endurance testing are as follows: Testing load: 1 kef, Flexion angle: 135 degrees, Flexion speed 175 times per minute. A sample belt has a width of 15 mm.

Next, with reference to FIGS. 9 through 12, a description is provided of installation and detachment of the secondary transfer belt 61.

Figure 9:
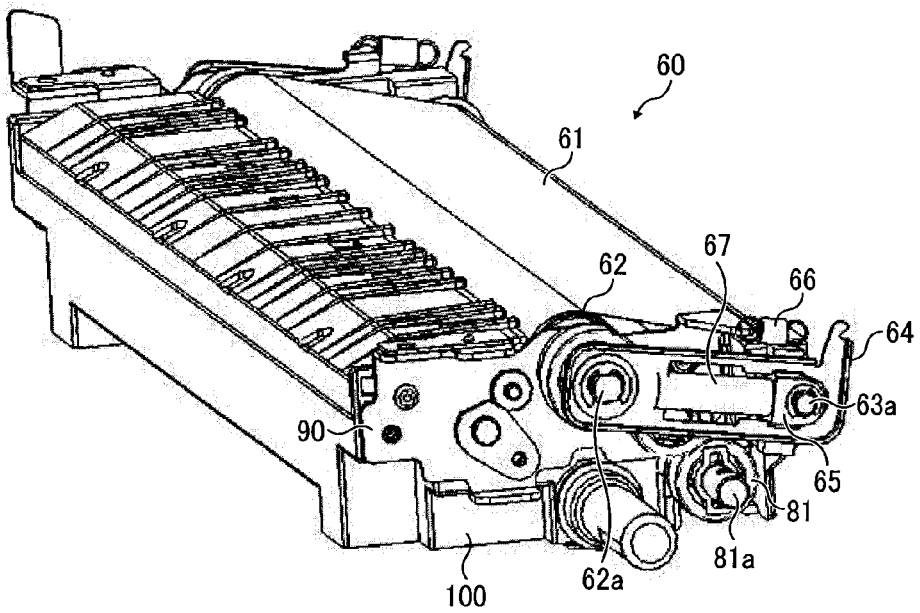
FIG. 9 is a perspective view schematically illustrating the secondary transfer device in a state (in use) in which the secondary transfer belt is stretched at a certain tension.

FIG. 9 is a perspective view schematically illustrating the secondary transfer device 60 in a state in which the secondary transfer belt 61 is stretched at a predetermined tension. In this state, the secondary transfer belt 61 is in use.

Figure 10:
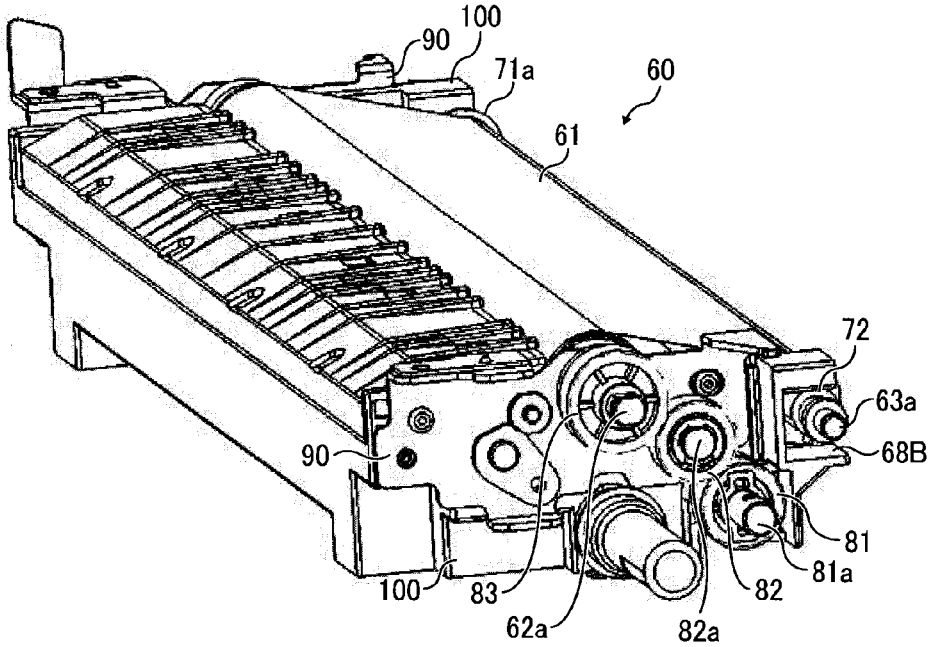
FIG. 10 is a perspective view schematically illustrating the secondary transfer device in a state (temporary holding state) in which a shaft support arm is detached from the secondary transfer device.

FIG. 10 is a perspective view schematically illustrating the secondary transfer device 60 in a state (temporary holding state) in which the shaft support arm 64 with the slidable shaft bearing 65, the arm spring 66, the tension spring 67, and so forth mounted thereon is detached from the secondary transfer device 60.

Figure 11:
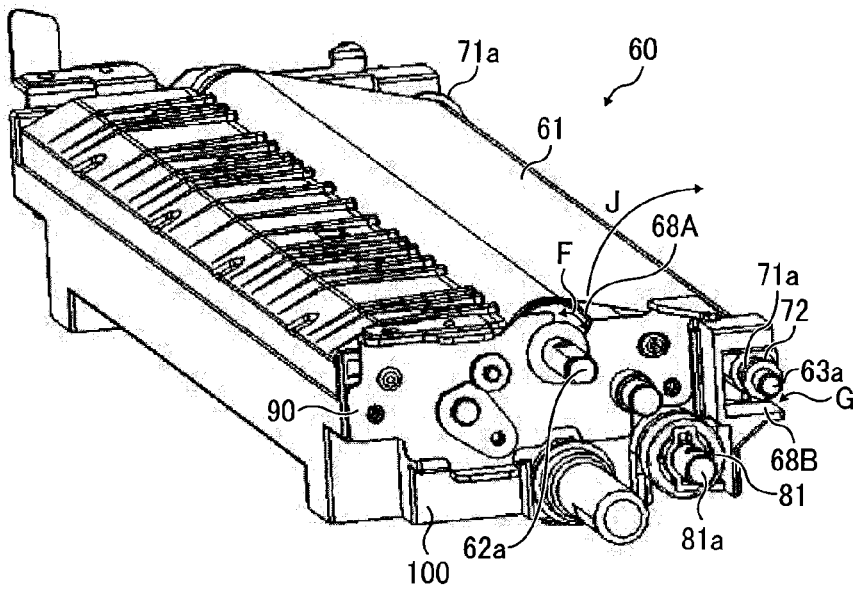
FIG. 11 is a perspective view schematically illustrating the secondary transfer device in a state in which a drive transmission device is detached from the secondary transfer device.

FIG. 11 is a perspective view schematically illustrating the secondary transfer device 60 in a state in which the secondary-transfer roller gear 83 and the idler gear 82 are removed from the respective support shafts.

Figure 12:
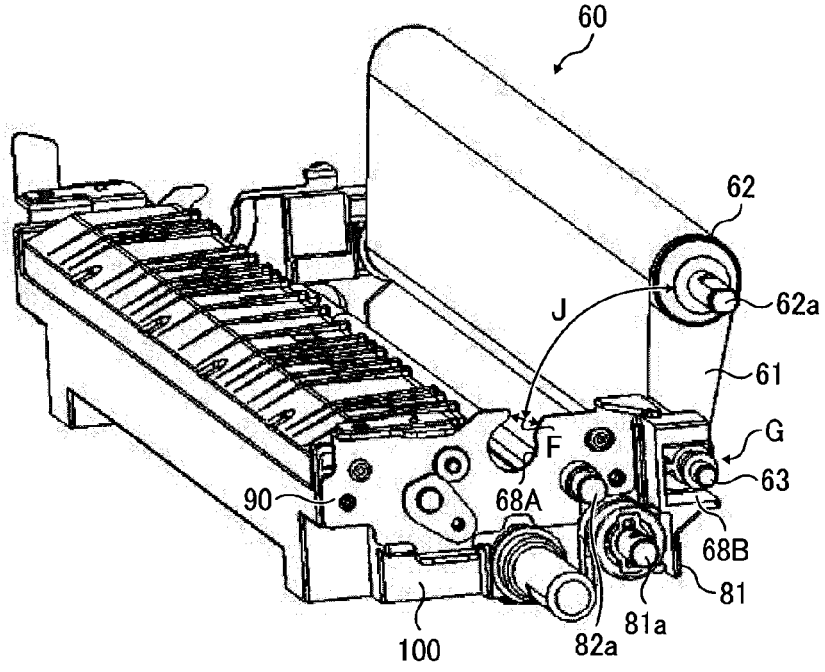
FIG. 12 is a perspective view schematically illustrating the secondary transfer device in a state (a relaxed tension state) in which a secondary transfer roller is detached from a frame.

FIG. 12 is a perspective view schematically illustrating the secondary transfer device 60 in a state (relaxed tension state) in which the secondary transfer roller 62 is detached from the lateral plate 90.

First, a description is provided of detachment operation of the secondary transfer belt 61 detached from the secondary transfer device 60.

As illustrated in FIG. 9, the separation roller 63 is biased by the tension spring 67 of the shaft support arm 64 in such a direction that the separation roller 63 separates from the secondary transfer roller 62. Accordingly, the secondary transfer belt 61 in use is stretched at a predetermined tension. According to the present illustrative embodiment, first, in order to reduce the tension of the secondary transfer belt 61, the shaft support arm 64 is detached from the ends of the rotary shaft 62*a* of the secondary transfer roller 62 and the rotary shaft 63*a* of the separation roller 63. Accordingly, the secondary transfer belt 61 is temporarily held in a manner as illustrated in FIG. 10. Subsequently, the idler gear 82 and the secondary-transfer roller gear 83 are removed from the respective support shafts from the state shown in FIG. 10.

According to the present illustrative embodiment, as illustrated in FIG. 11, the lateral plate 90 includes a second notch 68A that detachably holds the shaft bearing attached to the end portion of the rotary shaft 62*a* of the secondary transfer roller 62 serving as the second support roller. Furthermore, the shaft guide 68 includes a first notch 68B that contacts the slanted surface 72*a* of the shaft inclining member 72 disposed at the end portion of the rotary shaft 63*a* of the separation roller 63 serving as the first support roller. In the temporary holding state, the shaft bearing disposed at each end portion of the rotary shaft 62*a* of the secondary transfer roller 62 is held by the second notch 68A. The shaft inclining member 72 disposed at each end portion of the rotary shaft 63*a* of the separation roller 63 is held by the first notch 68B.

As illustrated in FIG. 11, the first notch 68B that holds the end portion of the rotary shaft 63*a* of the separation roller 63 includes an opening G which is sidewardly opened in a direction opposite to the secondary transfer roller 62 held in the notch 68A of the lateral plate 90. In the temporary holding state, the end portion of the rotary shaft 62*a* of the secondary transfer roller 62 is held by the second notch 68A, thereby restricting displacement of the secondary transfer roller 62 towards the separation roller 63. In this configuration, even when the distance between the rotary shaft 63*a* of the separation roller 63 and the rotary shaft 62*a* of the secondary transfer roller 62 needs to be increased to disengage the end portion of the rotary shaft 63*a* of the separation roller 63 from the opening G of the first notch 68B, it is difficult to obtain an enough distance that allows the end portion of the rotary shaft 63*a* of the separation roller 63 to be disengaged since the secondary transfer belt 61 is present.

By contrast, as illustrated in FIG. 12, the second notch 68A that detachably holds the end portion of the rotary shaft 62*a* of the secondary transfer roller 62 includes an opening F facing upward. More specifically, the end portion of the rotary shaft 62*a* of the secondary transfer roller 62 is inserted to and detached from the opening F of the second notch 68A. With this configuration, even when the shaft support arm 64 is detached from the end portions of the rotary shafts of the secondary transfer roller 62 and the separation roller 63, the end portions of the rotary shafts of the secondary transfer roller 62 and the separation roller 63 remain held by the lateral plate 90.

After the drive transmission device 80 is removed, the end portion of the rotary shaft 62*a* of the secondary transfer roller 62 is detached from the second notch 68A of the lateral plate 90. The opening F of the second notch 68A is formed such that in a state in which the secondary transfer roller 62 and the separation roller 63 are disposed inside the loop of the secondary transfer belt 61 the secondary transfer roller 62 is pivotally movable about the rotary shaft 63*a* of the separation roller 63 held by the shaft guide 68 in directions indicated by a double-headed arrow J in FIG. 12, thereby allowing the end portion of the rotary shaft 62*a* of the secondary transfer roller 62 to be detachably attachable relative to the second notch 68A. As illustrated in FIG. 12, as the secondary transfer roller 62 temporarily held is pivotally moved about the rotary shaft 63*a* of the separation roller 63 in the direction indicated by arrow J, the end portion of the rotary shaft 62*a* of the secondary transfer roller 62 can be detached from the second notch 68A of the lateral plate 90.

When the end portion of the rotary shaft 62*a* of the secondary transfer roller 62 is detached from the second notch 68A of the lateral plate 90, the secondary transfer roller 62 can move freely. As a result, the distance between the rotary shaft 62*a* of the secondary transfer roller 62 and the rotary shaft 63*a* of the separation roller 63 can be shortened, hence allowing the end portion of the rotary shaft 63*a* of the separation roller 63 to be detached from the opening G. After the end portion of the rotary shaft 63*a* of the separation roller 63 is detached from the first notch 68B, the secondary transfer belt 61 can be drawn out and detached from the secondary transfer roller 62 and the separation roller 63 in the axial direction of the rotary shafts of the secondary transfer roller 62 and the separation roller 63.

Next, a description is provided of installation of the secondary transfer belt 61 in the secondary transfer device 60.

Basically, the secondary transfer belt 61 is installed in the secondary transfer device 60 in reverse order as to when the secondary transfer belt 61 is detached therefrom. More specifically, the secondary transfer roller 62 and the separation roller 63 are inserted inside the looped the secondary transfer belt 61, that is, at the inner circumferential side of the secondary transfer belt 61. Subsequently, the end portion of the rotary shaft 63*a* of the separation roller 63 is inserted from the opening G to the first notch 68B of the shaft guide 68 of the secondary transfer device 60 as illustrated in FIG. 12. Subsequently, the end portion of the rotary shaft 62*a* of the secondary transfer roller 62 is pivotally moved about the separation roller 63 held by the shaft guide 68 to the second notch 68A of the lateral plate 90 while pulling the end portion of the rotary shaft 62*a* of the secondary transfer roller 62 such that the secondary transfer belt 61 is tensioned lightly. With this configuration, the end portion of the rotary shaft 62*a* of the secondary transfer roller 62 is inserted from the opening F of the lateral plate 90 to the second notch 68A, and the rotary shaft 62*a* of the secondary transfer roller 62 is held in a manner shown in FIG. 11.

Subsequently, the idler gear 82 is mounted on the idler shaft 82*a*, and the secondary-transfer roller gear 83 is mounted on the rotary shaft 62*a* of the secondary transfer roller 62 such as shown in FIG. 10. Subsequently, the shaft support arm 64 is attached to the end portion of the rotary shafts of the secondary transfer roller 62 and the separation roller 63. Accordingly, as illustrated in FIG. 9, the tension spring 67 of the shaft support arm 64 biases the separation roller 63 in such a direction that the separation roller 63 separates from the secondary transfer roller 62, thereby stretching the secondary transfer belt 61 at a predetermined tension. Accordingly, the secondary transfer belt 61 is stretched taut and becomes operable or in use.

According to the present illustrative embodiment of the present disclosure, the end portion of the rotary shaft 63*a* of the separation roller 63 is held by three planes of the first notch 68B with the opening facing outside the secondary transfer device 60. However, the configuration to hold the end portion of the rotary shaft 63*a* of the separation roller 63 is not limited to this. As long as there are at least two planes to support the rotary shaft 63*a*, the rotary shaft 63*a* of the separation roller 63 can be assembled although assemblage is degraded slightly.

Next, a description is provided of the place of installation of the drive transmission device 80 according to the illustrative embodiment of the present disclosure.

According to the present illustrative embodiment, as illustrated in FIG. 4, the drive transmission device 80 is disposed between the lateral plate 90 and the shaft support arm 64 in the axial direction of the separation roller 63. With this configuration, narrowing the distance between the shafts of the support rollers prevents the drive transmission device 80 and the shaft support arm 64 from contacting each other even when the drive transmission device 80 and the projection area of the shaft support arm 64 by normal light against the lateral plates 90 overlap.

With this configuration, the projection areas of the drive transmission device 80, the shaft support arm 64, and the lateral plates 90 by normal light can overlap without forming a relief hole in the shaft support arm 64 for the idler shaft 82*a* which is a part of the drive transmission device 80. Accordingly, the distance between the support rollers can be reduced without increasing the size of the movable supporting member, thereby downsizing the belt assembly.

Figure 13:
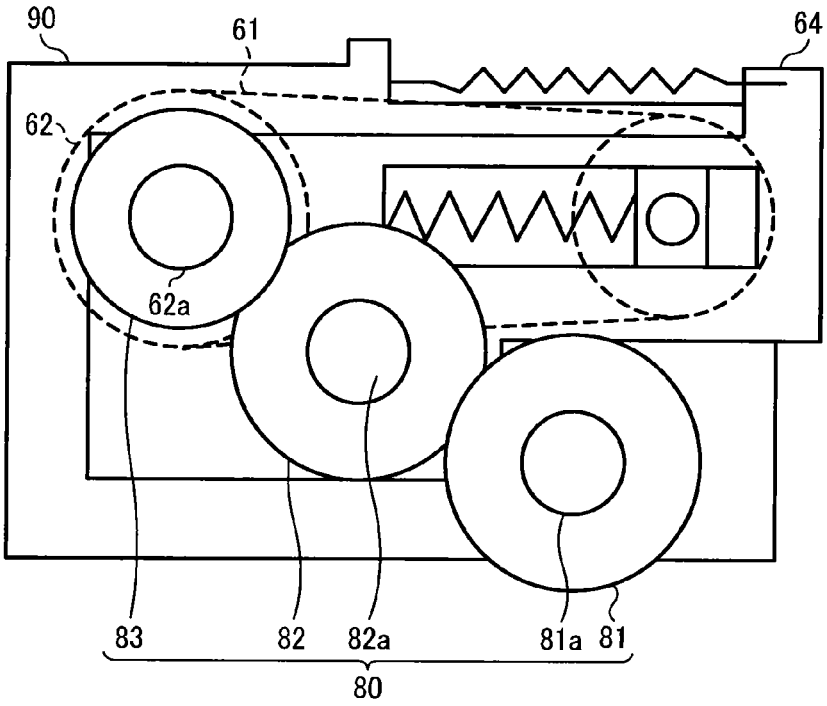
FIG. 13 is a schematic diagram illustrating a comparative example of the secondary transfer device including the drive transmission device.

FIG. 13 is a schematic diagram illustrating a comparative example of the secondary transfer device. In FIG. 13, the drive transmission device 80 of the secondary transfer device is disposed outside the shaft support arm 64 in the axial direction of the separation roller 63.

Figure 14:
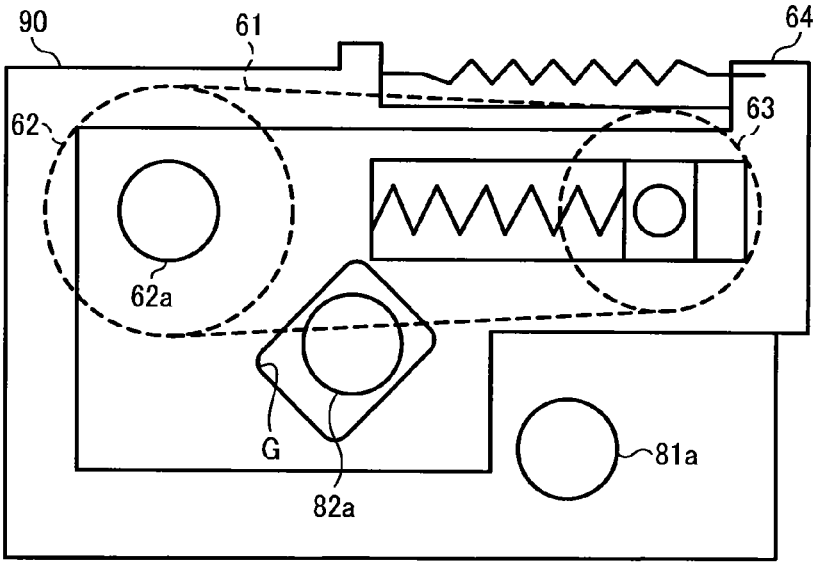
FIG. 14 is a schematic diagram schematically illustrating the drive transmission device of the secondary transfer device of FIG. 13 from which some parts are removed.

In this configuration, when the drive transmission device 80 is disposed outside the shaft support arm 64 in the axial direction of the separation roller 63, the idler shaft 82*a* disposed on the lateral plate 90 contacts the shaft support arm 64. In order to avoid the contact, as illustrated in FIG. 14, a relief hole G for the idler shaft 82*a* needs to be formed in the shaft support arm 64. In order to make up for the reduced strength due to the relief hole G, the size of the shaft support arm 64 is increased.

In a case in which the drive transmission device 80 is disposed outside the shaft support arm 64 in the axial direction of the separation roller 63, in order to downsize the belt assembly in the vertical direction in FIG. 14, the position of the idler shaft 82*a* shifts upward. Displacement of the idler shaft 82*a* upward in FIG. 14 causes the idler shaft 82*a* and a tension application device disposed on the shaft support arm 64 to interfere with each other more easily.

Figure 15:
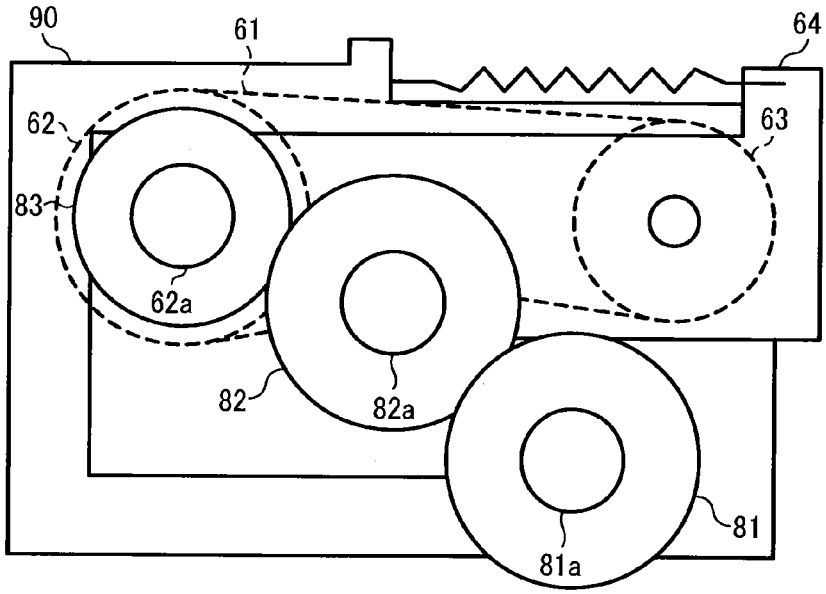
FIG. 15 is a schematic diagram illustrating a comparative example of the secondary transfer device including a tension application device.
Figure 16:
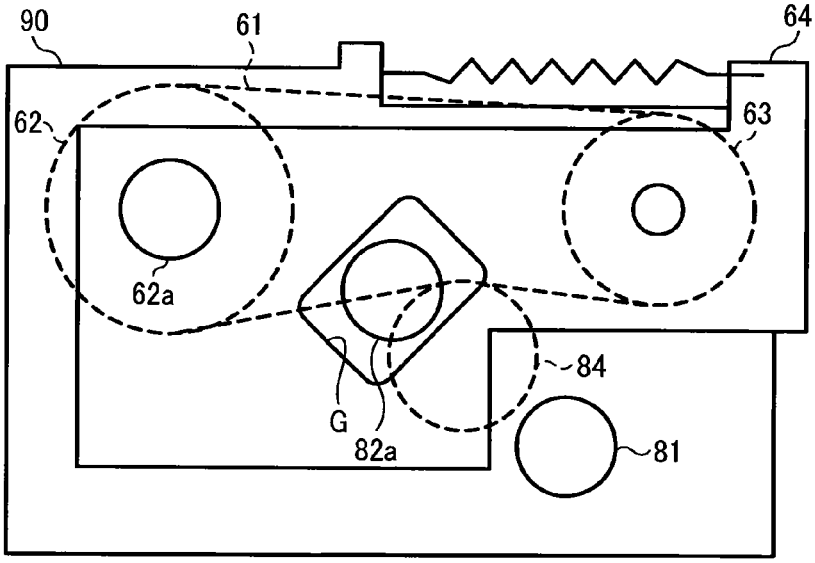
FIG. 16 is a schematic diagram illustrating the drive transmission device of the secondary transfer device of FIG. 15 from which some parts are removed.

As illustrated in FIG. 15, when disposing the idler shaft 82*a* at the upper portion in FIG. 14, the idler shaft 82*a* and the tension application device interfere with each other, so that a space to accommodate the tension application device on the shaft support arm 64 is not obtained. As a result, as illustrated in FIG. 16, an additional tension application device, i.e., a tension application device 84, needs to be disposed, resulting in an increase in the size of the belt assembly and the cost.

According to the present illustrative embodiment, the belt assembly includes the belt alignment device. The present disclosure can be applied to the belt assembly without the belt alignment device.

A description has been provided of an example of applying the belt assembly to the secondary transfer device 60. Similarly, the present disclosure can be applied to a belt assembly including an endless looped belt such as the intermediate transfer belt 51 and so forth.

Although the embodiments of the present disclosure have been described above, the present invention is not limited to the foregoing embodiments, but a variety of modifications can be made within the scope of the present invention.

[Aspect A]

A belt assembly includes a belt such as the secondary transfer belt 61 formed into an endless loop; a plurality of support rollers such as the separation roller 63 with a rotary shaft, about which the belt is entrained, to keep the belt taut, the plurality of support rollers including a first support roller such as the separation roller 63 and a second support roller; a shaft-end retainer such as the lateral plate 90 disposed at each end of the rotary shaft of the plurality of support rollers; a movable supporting member such as the shaft support arm 64 to support the first support roller, the movable supporting member being movably disposed relative to the shaft-end retainer; and a drive transmission device such as the drive transmission device 80 to transmit a driving force to one of the plurality of support rollers, the drive transmission device and the movable supporting member being disposed on a same side as the shaft-end retainer in an axial direction of the plurality of support rollers, the drive transmission device being disposed between the shaft-end retainer and the movable supporting member in the axial direction.

According to Aspect A, the drive transmission device is disposed between the shaft-end retainer and the movable supporting member in the axial direction of the support roller. With this configuration, even when the drive transmission device 80 and the projection area of the movable supporting member by normal light against the shaft-end retainer overlap, the drive transmission device and the movable supporting member can be disposed at a place at which the drive transmission device and the movable supporting member do not contact. Thus, even when the space between the shafts of the support rollers is reduced so as to downsize the belt assembly, the relief hole in the movable supporting member for prevention of interference of the drive transmission device and the movable supporting member is not necessary, hence preventing an increase in the size of the movable supporting member. Furthermore, the driving device does not have to be disposed at a position so as not to overlap with the projection area of the movable supporting member by normal light against the shaft-end retainer, hence preventing an increase in the size of the shaft-end retainer.

With this configuration, the space between the shafts of the support roller can be reduced without increasing the size of the movable supporting member, thereby downsizing the belt assembly.

[Aspect B]

According to Aspect A, the drive transmission device and the movable supporting member are disposed outside the shaft-end retainer in the axial direction.

With this configuration, the movable supporting member can be detached from the support roller easily, thereby facilitating detachment of the support roller from the shaft-end retainer and attachment of the belt without increasing the size of the belt assembly.

[Aspect C]

According to Aspect A or Aspect B, the movable supporting member rotates about a rotary shaft of the second support roller.

With this configuration, an additional rotary shaft for the movable supporting member is not necessary, thereby downsizing the belt assembly with a simple configuration.

[Aspect D]

According to any one of Aspects A through C, the movable supporting member is detachably attachable relative to the plurality of support rollers.

This configuration allows the support roller to be detached from the shaft-end retainer with ease, hence facilitating attachment of the belt without increasing the size of the belt assembly.

According to any one of Aspects A through D, the movable supporting member includes a biasing member to bias the first support roller in a direction in which the first support roller separates from the second support roller.

With this configuration, an additional biasing member to tension the belt is not necessary, thereby downsizing the belt assembly with a simple configuration.

[Aspect F]

According to Aspects A through E, the first support roller is a tiltable roller and includes a belt alignment device including an axial displacement device and a fixation member to regulate displacement of the belt in a width direction of the belt within a predetermined permissible range by tilting the rotary shaft of the tiltable roller, the axial displacement device is disposed at one end of a rotary shaft of the tiltable roller and moves along the rotary shaft of the tiltable roller to one end thereof in the width direction of the belt as the belt receives a force causing the belt to move in the width direction, and the fixation member contacts the axial displacement device from the one end in the width direction, at least one of the axial displacement device and the fixation member includes a slanted surface that contacts another of the axial displacement device and the fixation member, and as the belt receives the force causing the belt to move in the width direction the axial displacement device moves along the slanted surface relative to the fixation member to change a position of the end of the rotary shaft of the tiltable roller and tilt the rotary shaft of the tiltable roller, and the movable supporting member moves in conjunction with the tilt of the tiltable roller.

With this configuration, displacement of the belt is regulated with a simple configuration.

[Aspect G]

An image forming apparatus employs the belt assembly of any one of Aspects A through F. The belt assembly includes an endless looped belt that carries on its outer circumferential surface a sheet-type medium such as a recording medium on which an image is formed or recorded.

With this configuration, the size of the belt assembly employed in the image forming apparatus can be reduced with a simple configuration having a small number of parts.

[Aspect H]

According to Aspect G, the image forming apparatus includes a primary transfer device such as the primary transfer rollers 11*a*, 11*b*, 11*c*, and 11*d* to primarily transfer the image formed on a latent image bearing member such as the photoconductors 1*a*, 1*b*, 1*c*, and 1*d* onto the intermediate transfer member; and a secondary transfer device such as the secondary transfer device 60 to secondarily transfer the image on the intermediate transfer member onto the sheet-type medium carried on the outer circumferential surface of the belt.

With this configuration, the size of the secondary transfer device employed in the image forming apparatus can be reduced with a simple configuration having a small number of parts.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A belt assembly, comprising:

a belt formed into an endless loop;

a plurality of support rollers, each of the support rollers including a rotary shaft, about which the belt is entrained, to keep the belt taut, the plurality of support rollers including a first support roller and a second support roller;

a shaft-end retainer disposed at at least one end of the rotary shaft of the plurality of support rollers;

a movable supporting member to support the first support roller, the movable supporting member being movably disposed relative to the shaft-end retainer; and a drive transmission device to transmit a driving force to one of the plurality of support rollers, the drive transmission device and the movable supporting member being disposed on a same side as the shaft-end retainer in an axial direction of the plurality of support rollers, the drive transmission device being disposed between the shaft-end retainer and the movable supporting member in the axial direction, wherein the first support roller is a tiltable roller and includes a belt alignment device including an axial displacement device and a fixation member to regulate displacement of the belt in a width direction of the belt within a predetermined permissible range by tilting the rotary shaft of the tiltable roller, wherein the axial displacement device is disposed at one end of the rotary shaft of the tiltable roller and moves along the rotary shaft of the tiltable roller to one end thereof in the width direction of the belt as the belt receives a force causing the belt to move in the width direction, and the fixation member contacts the axial displacement device from the one end in the width direction, wherein at least one of the axial displacement device and the fixation member includes a slanted surface that contacts another of the axial displacement device and the fixation member, and as the belt receives the force causing the belt to move in the width direction, the axial displacement device moves along the slanted surface relative to the fixation member to change a position of the one end of the rotary shaft of the tiltable roller and tilt the rotary shaft of the tiltable roller, and the movable supporting member moves in conjunction with the tilt of the tiltable roller, and wherein the one end of the rotary shaft of the tiltable roller toward which the belt is moved is lowered to move the belt back to a desired position.

2. The belt assembly according to claim 1, wherein the drive transmission device and the movable supporting member are disposed outside the shaft-end retainer in the axial direction.

3. The belt assembly according to claim 1, wherein the movable supporting member rotates about a rotary shaft of the second support roller.

4. The belt assembly according to claim 1, wherein the movable supporting member is detachably attachable relative to the plurality of support rollers.

5. The belt assembly according to claim 1, wherein the movable supporting member includes a biasing member to bias the first support roller in a direction of tensioning the belt.

6. The belt assembly according to claim 1, wherein the axial displacement device is biased against the fixation member.

7. An image forming apparatus, comprising a belt assembly, the belt assembly including a belt formed into an endless loop to bear one of an image and a sheet-type medium on which an image is recorded;

a plurality of support rollers, each of the support rollers including a rotary shaft, about which the belt is entrained, to keep the belt taut, the plurality of support rollers including a first support roller and a second support roller;

a shaft-end retainer disposed at at least one end of the rotary shaft of the plurality of support rollers;

a movable supporting member to support the first support roller, the movable supporting member being movably disposed relative to the shaft-end retainer; and a drive transmission device to transmit a driving force to one of the plurality of support rollers, the drive transmission device and the movable supporting member being disposed on a same side as the shaft-end retainer in an axial direction of the plurality of support rollers, the drive transmission device being disposed between the shaft-end retainer and the movable supporting member in the axial direction, wherein the first support roller is a tiltable roller and includes a belt alignment device including an axial displacement device and a fixation member to regulate displacement of the belt in a width direction of the belt within a predetermined permissible range by tilting the rotary shaft of the tiltable roller, wherein the axial displacement device is disposed at one end of the rotary shaft of the tiltable roller and moves along the rotary shaft of the tiltable roller to one end thereof in the width direction of the belt as the belt receives a force causing the belt to move in the width direction, and the fixation member contacts the axial displacement device from the one end in the width direction, wherein at least one of the axial displacement device and the fixation member includes a slanted surface that contacts another of the axial displacement device and the fixation member, and as the belt receives the force causing the belt to move in the width direction, the axial displacement device moves along the slanted surface relative to the fixation member to change a position of the one end of the rotary shaft of the tiltable roller and tilt the rotary shaft of the tiltable roller, and the movable supporting member moves in conjunction with the tilt of the tiltable roller, and wherein the one end of the rotary shaft of the tiltable roller toward which the belt is moved is lowered to move the belt back to a desired position.

8. The image forming apparatus according to claim 7, further comprising:

a latent image bearing member to bear an image on a surface thereof;

an intermediate transfer member onto which the image is transferred from the latent image bearing member;

a primary transfer device to primarily transfer the image formed on the latent image bearing member onto the intermediate transfer member; and a secondary transfer device to secondarily transfer the image on the intermediate transfer member onto the sheet-type medium borne on an outer circumferential surface of the belt.

9. The image forming apparatus according to claim 7, wherein the axial displacement device is biased against the fixation member.

* * * * *